US011095064B2

(12) United States Patent
Ikeya et al.

(10) Patent No.: US 11,095,064 B2
(45) Date of Patent: Aug. 17, 2021

(54) CONNECTOR STRUCTURE

(71) Applicant: Yazaki Corporation, Tokyo (JP)

(72) Inventors: Kazuhide Ikeya, Makinohara (JP); Hikaru Anma, Makinohara (JP); Sho Kasuya, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 16/822,194

(22) Filed: Mar. 18, 2020

(65) Prior Publication Data

US 2020/0303860 A1 Sep. 24, 2020

(30) Foreign Application Priority Data

Mar. 18, 2019 (JP) ..... JP2019-049976

(51) Int. Cl.
*H01R 13/436* (2006.01)

(52) U.S. Cl.
CPC ..... *H01R 13/4362* (2013.01)

(58) Field of Classification Search
CPC ..... H01R 13/4365; H01R 13/4362; H01R 13/4361
USPC ..... 439/595, 752
See application file for complete search history.

(56) References Cited

U.S. PATENT DOCUMENTS 5,474,477 A * 12/1995 Aoyama ..... H01R 13/4362 439/752
5,516,308 A * 5/1996 Yamanashi ..... H01R 13/4362 439/752
5,775,600 A * 7/1998 Wildeson ..... F02M 51/0671 239/585.1
5,997,364 A * 12/1999 Matsuoka ..... H01R 13/4362 439/595
6,261,133 B1 7/2001 Kubo et al.
6,655,999 B2 * 12/2003 Mase ..... H01R 13/4223 439/595
7,044,808 B1 5/2006 Foltz et al.
7,988,502 B2 8/2011 Nagano et al.
9,083,114 B2 * 7/2015 Muro ..... H01R 13/4362
9,859,645 B2 1/2018 Ohfuku et al.
10,476,193 B2 * 11/2019 Miyamura ..... H01R 13/42
10,847,916 B2 * 11/2020 Endo ..... H01R 13/4361
(Continued)

FOREIGN PATENT DOCUMENTS

JP 2000-252000 A 9/2000
JP 2008-543026 A 11/2008
(Continued)

*Primary Examiner* — Gary F Paumen
(74) *Attorney, Agent, or Firm* — Banner & Witcoff, Ltd.

(57) ABSTRACT

A connector structure has a housing including a connection portion and a retainer to be attached to the connection portion from a lateral side of the connection portion and to lock, when the retainer is attached to the connection portion, the terminal. The connection portion includes an upper portion and a lower portion, at least one of which having a guide rail. The retainer includes a pair of plate portions and a coupling portion coupling the plate portions to each other at a first side of the retainer, the retainer being to be attached to the connection portion from a second side of the retainer, the second side being opposite to the first side. At least one of the plate portions has a slide rail to engage with the guide rail when the retainer is attached to the connection portion.

6 Claims, 14 Drawing Sheets

(56) References Cited

U.S. PATENT DOCUMENTS

| | | | | |
|---|---|---|---|---|
| 2003/0068930 | A1* | 4/2003 | Endo | H01R 13/4362<br>439/752 |
| 2003/0087563 | A1* | 5/2003 | Endo | H01R 13/4362<br>439/752 |
| 2004/0132351 | A1* | 7/2004 | Miyakawa | H01R 13/4361<br>439/752 |
| 2010/0068911 | A1 | 3/2010 | Nagano et al. | |
| 2017/0069983 | A1 | 3/2017 | Ohfuku et al. | |
| 2020/0203877 | A1 | 6/2020 | Ohfuku et al. | |

FOREIGN PATENT DOCUMENTS

| | | | |
|---|---|---|---|
| JP | 2010-073375 | A | 4/2010 |
| JP | 2017-054674 | A | 3/2017 |
| WO | 2019-045041 | A1 | 3/2019 |

* cited by examiner

CONNECTOR STRUCTURE

CROSS-REFERENCE TO RELATED APPLICATION

The present application claims priority to Japanese Patent Application No. 2019-049976 filed on Mar. 18, 2019, the entire content of which is incorporated herein by reference.

TECHNICAL FIELD

The present invention relates to a structure of a connector.

BACKGROUND

A related art connector includes a housing in which a retainer locks a terminal accommodated in a terminal accommodating chamber by attaching the retainer to a connection portion of the connector from a side of the connection portion, the connection portion having the terminal accommodating chamber (see, for example, JP-2010-73375A, JP-2000-252000A).

With the connector described above, an operator can notice that the terminal is not completely inserted into the terminal accommodating chamber (half-insertion state of the terminal), since a lance of the retainer interferes with the terminal, and as a result, the retainer cannot be attached to the connection portion when the termnial is incompletely inserted into the terminal accommodating chamber. The retainer to be attached from the side to the connection portion is formed in a U shape in a cross-sectional view opened to a side. Therefore, when an external force is applied on the retainer attached to the connection portion or when a wire is tensioned and a force therefrom is applied from the terminal to the lance of the retainer, the retainer may open and the terminal may not be sufficiently locked. When the retainer is forcibly pushed to the connection portion with the terminal only half-inserted to the terminal accommodating chamber, the retainer may be attached on the connection portion with the opened side of the retainer gets on the terminal and opens, resulting in the retainer being attached to the connection portion with the terminal incompletely inserted.

SUMMARY

Illustrative aspects of the present invention provide a connector structure configured to prevent deformation of a retainer and reliably maintain the locking of a terminal by the retainer.

According to an illustrative aspect of the present invention, a connector structure has a housing including a connection portion, the connection portion including a terminal accommodating chamber configured to accommodate a terminal and a retainer configured to be attached to the connection portion from a lateral side of the connection portion and to lock, when the retainer is attached to the connection portion from the lateral side of the connection portion, the terminal accommodated in the terminal accommodating chamber. The connection portion includes an upper portion and a lower portion, at least one of the upper portion and the lower portion having a guide rail extending along a direction in which the retainer is attached to the connection portion. The retainer includes a pair of plate portions and a coupling portion coupling the plate portions to each other at a first side of the retainer, the plate portions being configured to extend along the upper portion and the lower portion of the connection portion when the retainer is attached to the connection portion, the retainer being configured to be attached to the connection portion from a second side of the retainer, the second side being opposite to the first side. At least one of the plate portions has a slide rail configured to engage with the guide rail when the retainer is attached to the connection portion, the slide rail extending along the direction in which the retainer is attached to the connection portion.

Other aspects and advantages of the invention will be apparent from the following description, the drawings and the claims.

DETAILED DESCRIPTION

Figure 1:
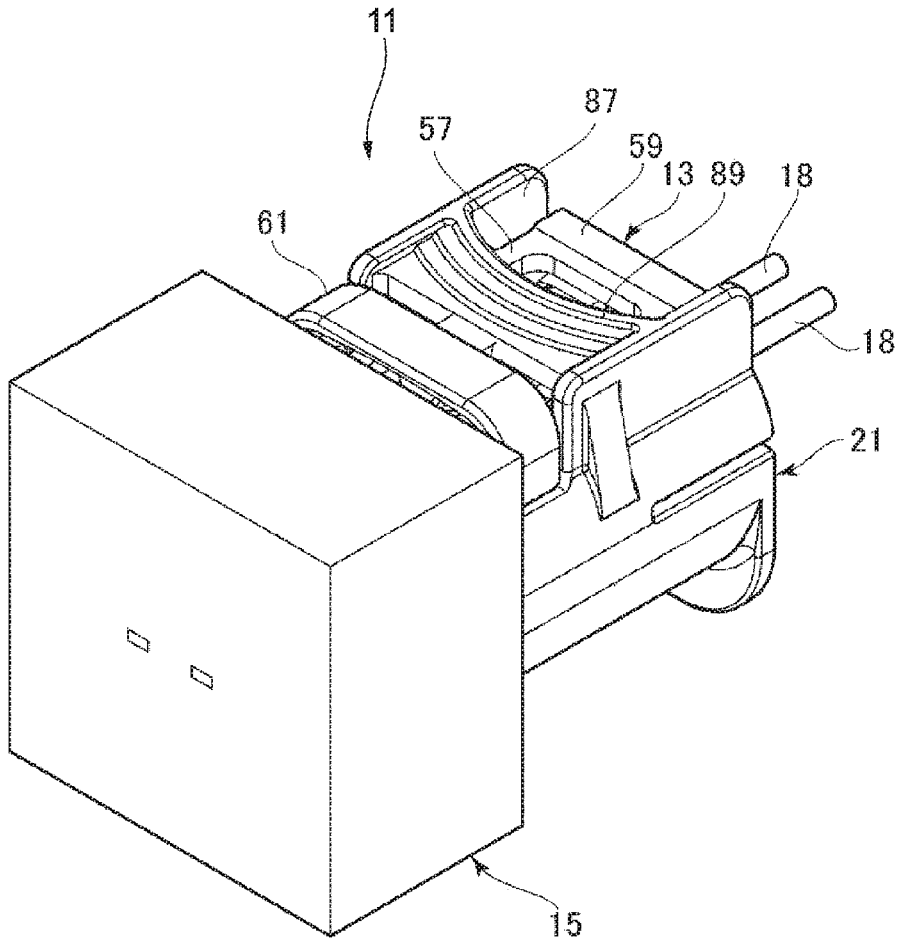
FIG. 1 is a perspective view of a connector according to the present embodiment fitted to a mating connector.
Figure 2:
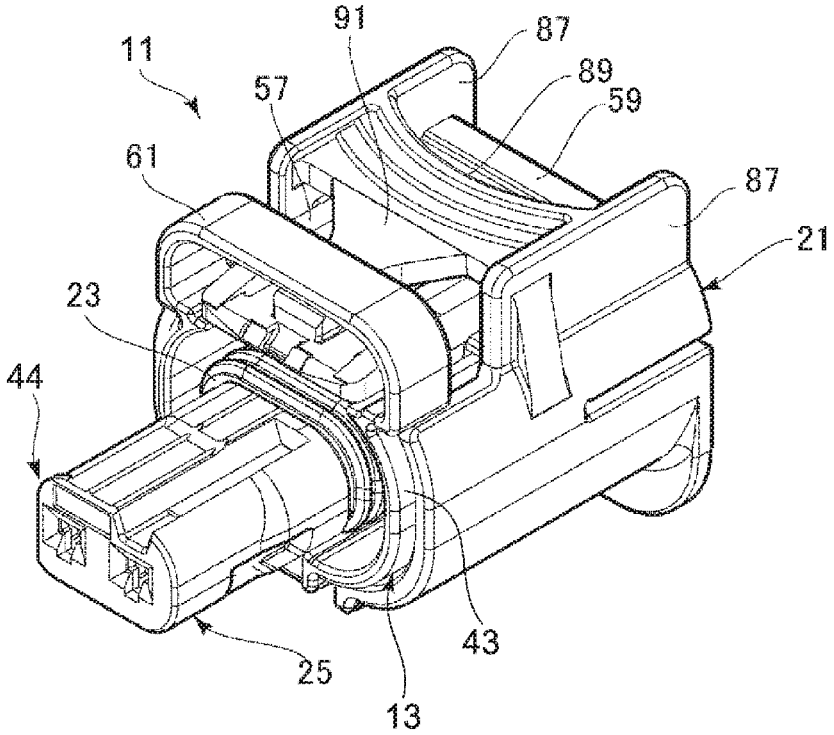
FIG. 2 is a perspective view of the connector according to the present embodiment.
Figure 3:
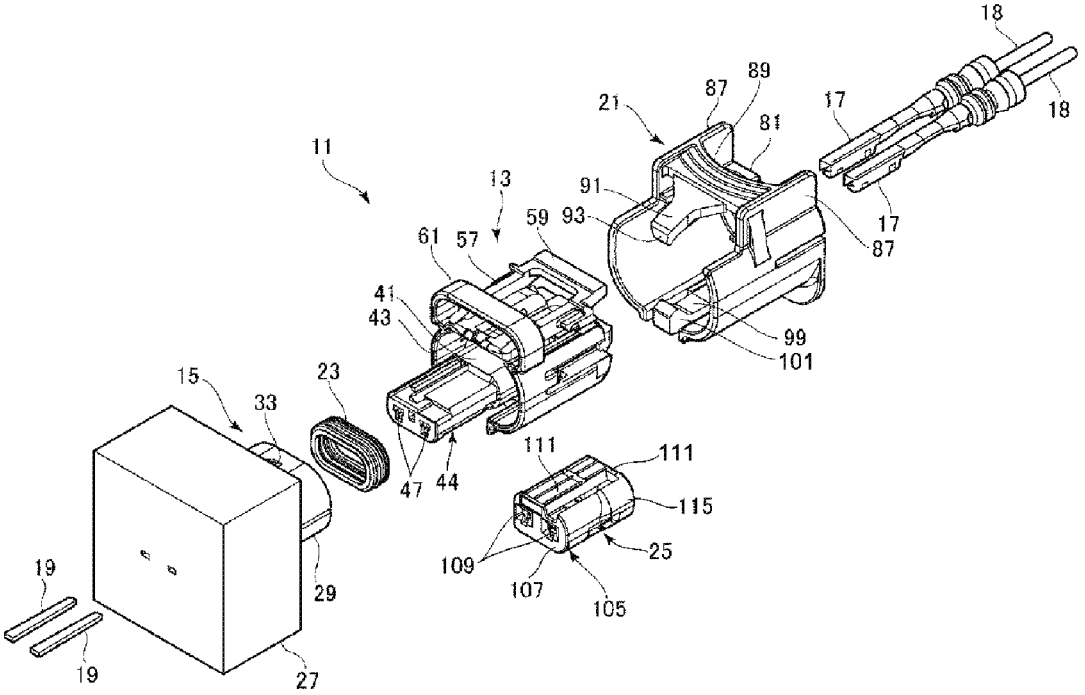
FIG. 3 is an exploded perspective view of the connector according to the present embodiment.
Figure 4:
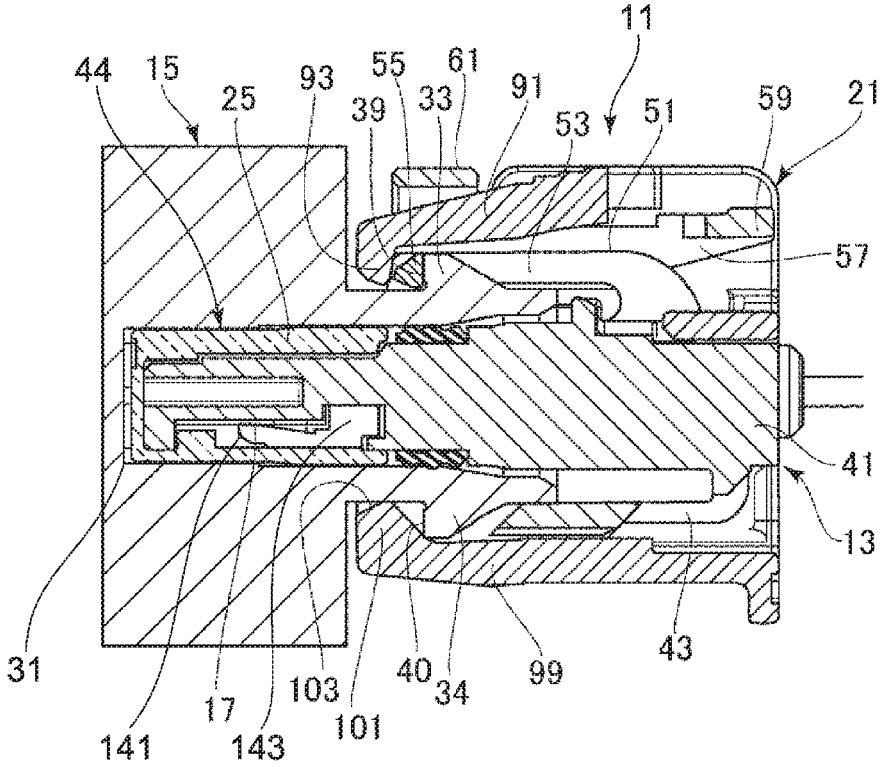
FIG. 4 is a longitudinal cross-sectional view of the connector in a state in which the connector is completely fitted to the mating connector (a fitted state to the mating connector)

Hereinafter, exemplary embodiments of the present invention will be described in detail with reference to the drawings. FIG. 1 is a perspective view of a connector according to the present embodiment fitted to a mating connector. FIG. 2 is a perspective view of the connector according to the present embodiment. FIG. 3 is an exploded perspective view of the connector according to the present embodiment. FIG. 4 is a longitudinal cross-sectional view of the connector in a fitted state to the mating connector. Hereinafter, it is described that a side in a direction in which the connector gets close to the mating connector to be fitted to the mating connector is defined as front (front side in a fitting direction of the connector to the mating connector). Similarly, it is described that a side in a direction in which the connector gets away from the mating connector is defined as rear (rear side in the fitting direction), one side (upper side in FIG. 4) in a connector height direction (height direction), which is substantially orthogonal to the fitting direction is defined as an upper side, the other side (lower side in FIG. 4) thereof is defined as a lower side, and a connector width direction (width direction) substantially orthogonal to the fitting direction and the connector height direction is defined as a left-right direction.

As shown in FIGS. 1 to 4, a connector 11 includes a female housing (housing) 13 having a tubular shape, a male housing (mating housing) 15 having a tubular shape, female terminals (terminals) 17 to be accommodated in the female housing 13, male terminals (terminals) 19 to be accommodated in the male housing 15, a tubular CPA (fitting assurance member) 21 slidably attached to an outer surface of the female housing 13 in the fitting direction, an annular sealing member 23 to be attached to the female housing 13, and a retainer 25 to be attached to the female housing 13. In the connector 11 of the present embodiment, two pairs of female terminals 17 and male terminals 19 are to be connected, and two female terminals 17 are to be accommodated in the female housing 13, and two male terminals 19 are to be accommodated in the male housing 15.

The male housing 15 is made of synthetic resin, and is to be directly connected to a wall of an electric device (not shown) mounted on a vehicle or the like, for example. The male housing 15 includes a base end portion 27 corresponding to the device wall. The male housing 15 includes a cylindrical hood portion 29 extending from the base end portion 27 along the fitting direction. A bottomed hole 31 is formed in the base end portion 27, and a male terminal 19 having a tab shape protruding along the fitting direction is fixed to a bottom of the hole 31 (the back side of the hole 31).

An upper locking projection 33 is provided to protrude from the upper surface of an outer periphery of the hood portion 29. The upper locking projection 33 includes an upper inclined surface 35, an upper flat surface 37 and an upper locking surface 39. The upper inclined surface 35 increases in height toward a front side in the fitting direction. The upper flat surface 37 is continuous with an upper end (rear end) of the upper inclined surface 35 and extends along a front-rear direction. The upper locking surface 39 is continuous with a rear end of the upper flat surface 37 and stands substantially vertically. Similarly, a lower locking projection 34 is provided to protrude from a lower surface of the outer periphery of the hood portion 29. The lower locking projection 34 includes a lower inclined surface 36, a lower flat surface 38 and a lower locking surface 40. The lower inclined surface 36 increases in height toward the front side in the fitting direction. The lower flat surface 38 is continuous with an upper end (rear end) of the lower inclined surface 36 and extends along the front-rear direction. The lower locking surface 40 is continuous with a rear end of the lower flat surface 38 and stands substantially vertically. The upper locking projection 33 and the lower locking projection 34 are formed substantially symmetrically in the vertical direction. The upper inclined surface 35 and the lower inclined surface 36 extend for substantially the same length in the fitting direction. The upper flat surface 37 and the lower flat surface 38 extend for substantially the same length.

Figure 5:
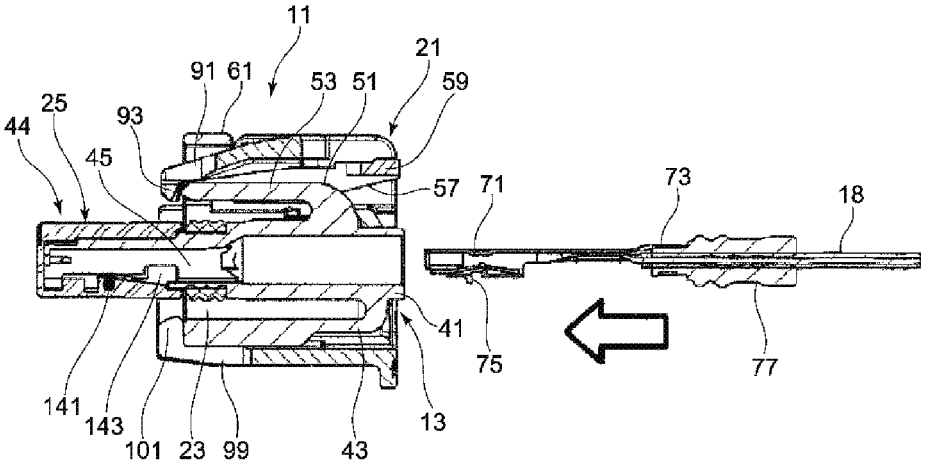
FIG. 5 is a longitudinal cross-sectional view of the connector before a female terminal being inserted into the connector.

FIG. 5 is a longitudinal cross-sectional view of the connector before the female terminal being inserted into the connector. As shown in FIG. 5, the female housing 13 is formed by a inner housing 41 having a tubular shape and an outer housing 43 having a tubular shape. The outer housing 43 is provided with a space in between the outer housing 43 and an outer peripheral surface of the inner housing 41. The outer housing 43 surrounds the outer peripheral surface of the inner housing 41. The female housing 13 is made of synthetic resin. The hood portion 29 of the male housing 15 is to be inserted into the space (a gap) between the outer peripheral surface of the inner housing 41 and an inner peripheral surface of the outer housing 43.

Two terminal accommodating chambers 45 into which the female terminals 17 are to be inserted from the rear are formed in the inner housing 41. Each terminal accommodating chamber 45 is opened to an outside at an insertion hole 47 formed in a distal end portion of the inner housing 41 in the front side. The male terminal 19 is to be inserted into earh insertion hole 47.

The female terminals 17 to be inserted and to be accommodated in the terminal accommodating chambers 45 are connected to end portions of electric wires 18. The female terminal 17 includes an electrical connection portion 71 that has a rectangular tubular shape. The electrical connection portion 71 is to be electrically connected to the male terminal 19 by the male terminal 19 being inserted into the electrical connection portion 71. A wire connection portion 73 is to be crimped to the end portion of the electric wire 18 and to be electrically connected to the conductor of the electric wire 18. A locking piece 75 is provided on a lower surface of the electrical connection portion 71. The electric wire 18 to which the female terminal 17 is connected is provided with a rubber plug 77 at an end at which the electric wire 18 is to be connected to the female terminal 17. The rubber plug 77 is to be fitted into the terminal accommodating chamber 45 to seal the terminal accommodating chamber 45.

The inner housing 41 extends beyond a rear end of the outer housing 43 in the rear side of the fitting direction. A seal member 23 is to be attached to a cylindrical outer peripheral surface of the inner housing 41 surrounded by the outer housing 43. A distal end portion of the outer housing 43 serves as a connection portion 44 to which the retainer 25 is to be attached to the outer periphery thereof. The connection portion 44 is to be fitted and connected to the male housing 15 together with the retainer 25. A portion of the connection portion 44 to which the retainer 25 is to be attached protrudes to the front side in the fitting direction toward the male housing 15 from the outer housing 43 of the female housing 13.

An elastically deformable housing arm 51 is formed on the outer peripheral surface of the female housing 13. The housing atm 51 is formed in a gate shape, and is supported in a cantilever manner on the outer peripheral surface of the female housing 13. The housing arm 51 includes a pair of left and right elastic arm pieces 53 and locking pieces 55. The elastic arm pieces 53 extend toward the male housing 15, the elastic arm pieces 53 being substantially parallel to the outer peripheral surface of the inner housing 41. The locking pieces 55 bridge front end portions of the elastic arm pieces 53 in the width direction. The locking pieces 55 lock the upper locking projection 33 of the male housing 15 when two housings 13, 15 are fitted to each other.

The housing arm 51 is elastically deformable by the locking piece 55 swinging upward (outward) using a rear end portion thereof as a fulcrum. The housing arm 51 is supported in a cantilever manner at the rear end portions of the pair of elastic arm pieces 53. A gate-shaped lock arm 57 extending rearward is connected to the housing arm 51. The lock arm 57 includes an operation portion 59 which is to be pressed to release the housing arm 51 from a locked state. The operation portion 59 is disposed at a position higher than the elastic arm pieces 53.

The female housing 13 includes a female housing bridge 61 that rises upward from both left and right ends of the outer housing 43. The female housing bridge 61 extends in the width direction, thereby covering the locking pieces 55 from outside (upper side). The female housing bridge 61 is positioned such that the female housing bridge 61 allows elastic deformation of the locking pieces 55 pushed by the upper inclined surface 35 of the male housing 15 to elastically deformed. The female housing bridge 61 is provided in the vicinity of an outer limit of a space in which the locking pieces 55 is movable.

Figure 6:
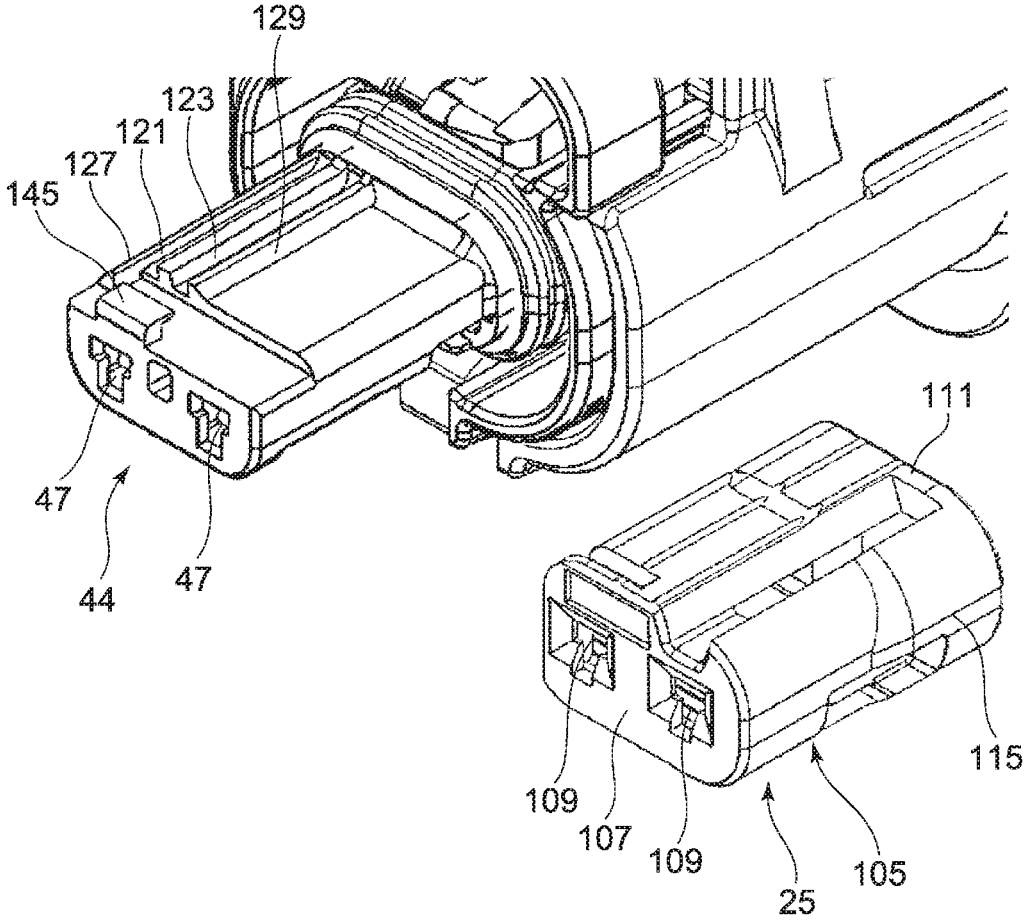
FIG. 6 is a perspective view of a connection portion and a retainer.
Figure 7:
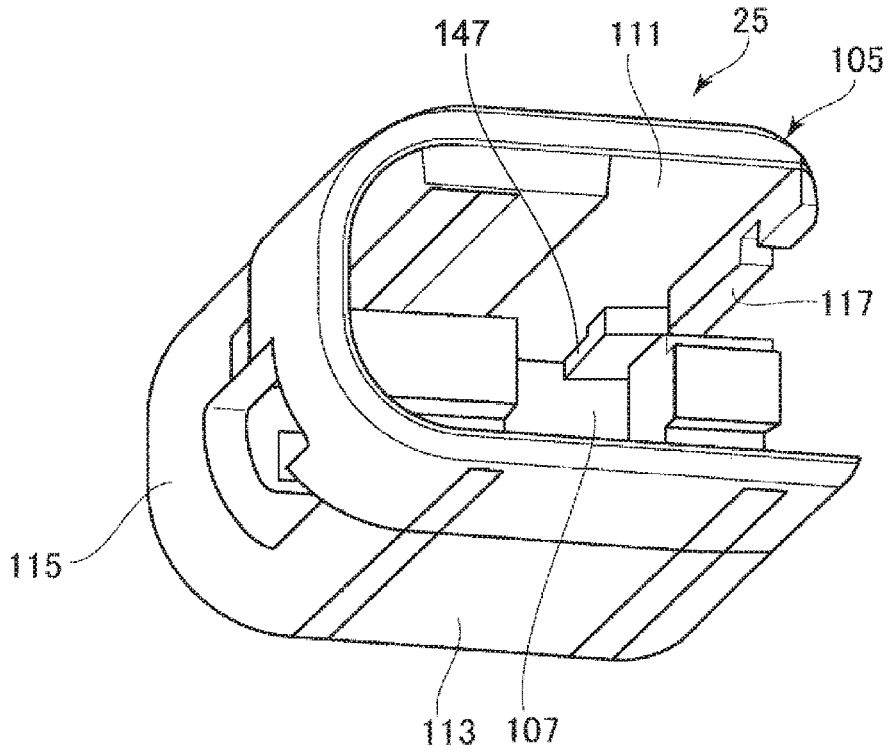
FIG. 7 is a perspective view of the retainer as viewed from a rear side thereof.
Figure 8:
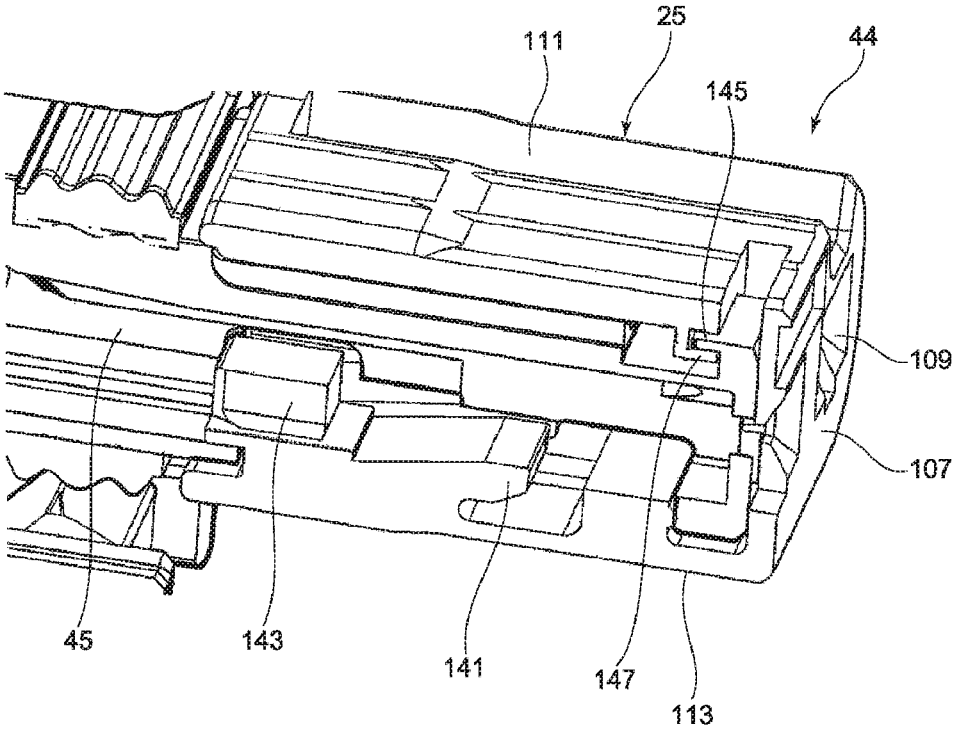
FIG. 8 is a perspective view of the connection portion to which the retainer is attached as viewed in a cross section along a fitting direction of the connector.
Figure 9A:
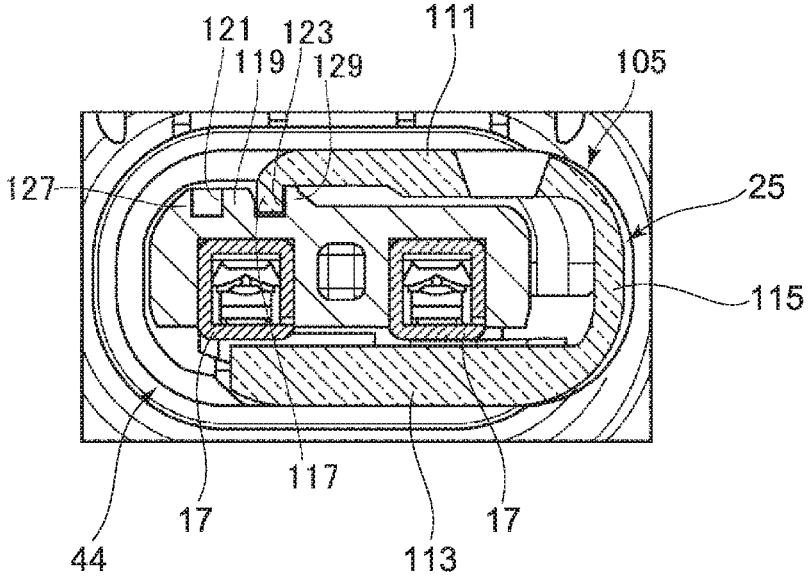
FIG. 9A is a transverse cross-sectional view of a state where the retainer is disposed at a temporary locked position (first position)
Figure 9B:
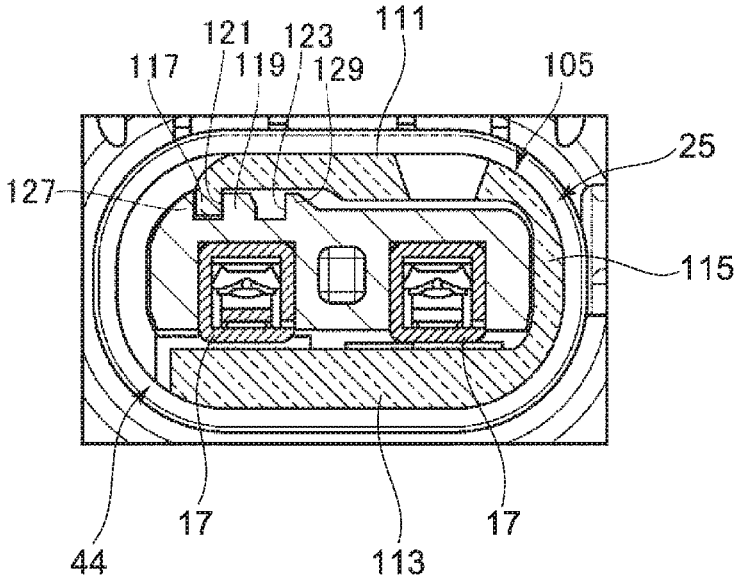
FIG. 9B is a transverse cross-sectional view of the retainer in a final locked position (second position)
Figure 10A:
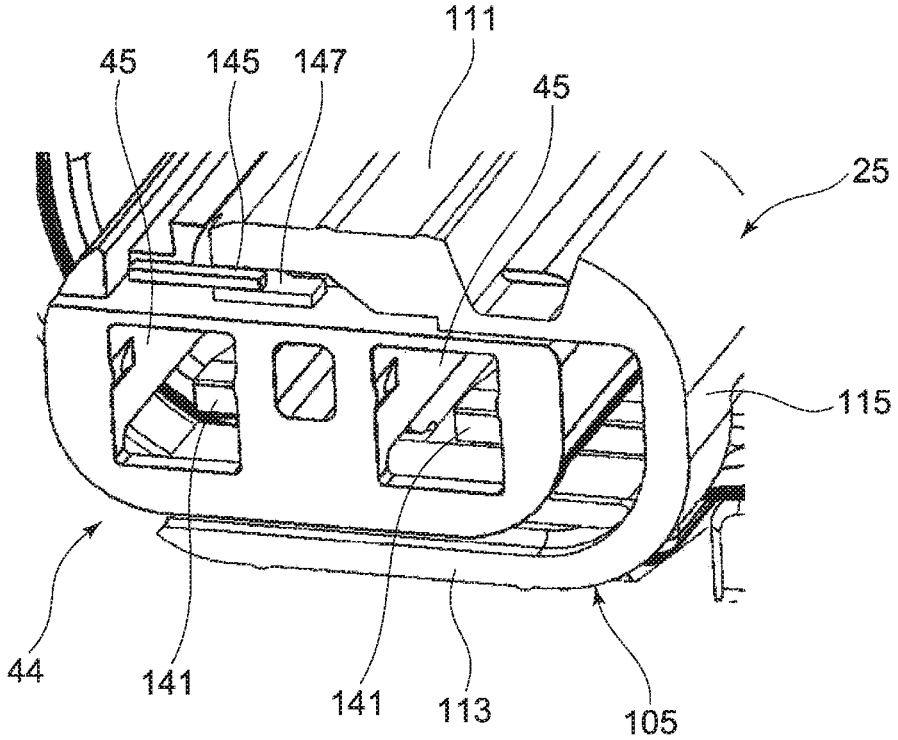
FIG. 10A is a perspective view of the connection portion in a state in which the retainer is disposed at the temporary locked position as viewed from a direction orthogonal to the fitting direction.
Figure 10B:
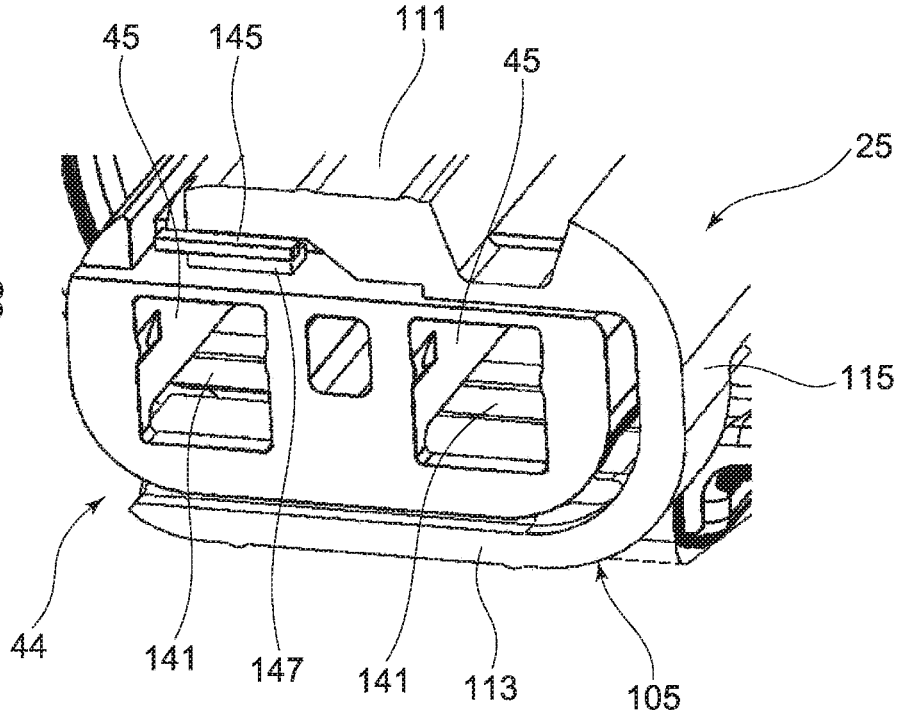
FIG. 10B is a perspective view of the connection portion in a state where the retainer is disposed at the final locked position as viewed from a direction orthogonal to the fitting direction.

FIG. 6 is a perspective view of a connection portion and a retainer. FIG. 7 is a perspective view of the retainer as viewed from a rear side thereof. FIG. 8 is a perspective view of the connection portion to which the retainer is to be attached as viewed in a cross section along the fitting direction. FIGS. 9A and 9B are views showing a state of the retainer being attached to the connection portion. More specifically, FIG. 9A is a transverse cross-sectional view of a state in which the retainer is disposed at a temporary locked position, and FIG. 9B is a transverse cross-sectional view of the retainer in a final locked position. FIGS. 10A and 10B are views showing a state of the retainer being attached to the connection portion. More specifically, FIG. 10A is a perspective view of the connection portion in a state in which the retainer is disposed at the temporary locked position as viewed from a direction orthogonal to the fitting direction, and FIG. 10B is a perspective view of the connection portion in a state where the retainer is disposed at the final locked position as viewed from a direction orthogonal to the fitting direction.

As shown in FIGS. 6 to 8, the retainer 25 includes a U-shaped cross section retainer body 105 opening one side in the width direction and a front plate portion 107 covering a front end of the retainer body. The retainer 25 is made of synthetic resin. Two insertion holes 109 are formed in the front plate portion 107. The insertion holes 109 communicate with the insertion hole 47 of the inner housing 41 in a state where the retainer 25 is in a final locked position which will be described later, and the male terminal 19 is to be inserted into the insertion holes 47, 109.

The retainer body 105 integrally includes a pair of plate portions 111, 113 and a coupling portion 115. The pair of plate portions 111, 113 are spaced apart from each other and face each other. The coupling portion 115 couples an end edge of the upper plate portion 111 and an end edge of the lower plate portion 113. In other words, the coupling portion 115 couples the pair of plate portions 111, 113 at a first side of the retainer 25. The retainer 25 has the first side and a second side. The second side of the retainer 25 is opposite to the first side of the retainer 25. The retainer 25 is configured to be attached to the connection portion 44 from the second side of the retainer 25. A retainer projection 117 linearly extending along the fitting direction is projected downward from an end edge of the upper plate portion 111 on an opened side of the retainer 25.

On the upper surface of the connection portion 44, a final locking groove 121 and a temporary locking groove 123 are provided with a partition wall 119 in between. The partition wall 119, the final locking groove 121, and the temporary locking groove 123 linearly extend along the fitting direction. The final locking groove 121 is defined by an end side wall 127 of the connection portion 44 protruding from the upper surface of the connection portion 44 and the partition wall 119. The temporary locking groove 123 is defined by a groove forming projection 129 protruding from the upper surface of the connection portion 44 and the partition wall 119.

A lance (first locking portion) 141 and a final locking projection (second locking portion) 143 projecting inward are formed in the plate portion 113 on the lower side of the retainer 25. The lance 141 is provided on a further front side of an insertion direction, a direction in which the female terminal 17 is inserted into the terminal accommodating chamber 45, than the final locking projection 143. The lance 141 is elastically deformable. The lance 141 is inclined such that a distal end thereof protrudes toward the upper plate portion 111 and toward the front side in the insertion direction.

A plate guide rail 145 is formed in an upper surface of the connection portion 44 in a distal end side in the front direction. The guide rail 145 is connected to the connection portion 44 at the distal end side. The guide rail 145 extends along a direction to which the retainer 25 is attached to the connection portion 44 (attachment direction of the retainer 25). A side in a direction in which the retainer 25 gets close to the connection portion 44 to be attached to the connection portion 44 is defined as front in the attachment direction of the retainer 25 and a side in a direction in which the retainer 25 gets away from the connection portion 44 is defined as rear in the attachment direction of the retainer 25. The guide rail 145 is provided on a front end side in the attachment direction of the retainer 25. In other words, when the retainer 25 is attached to the connection portion 44, the guide rail 145 is disposed in the vicinity of the second side of the retainer 25.

Further, a slide rail 147 having a plate-like shape is formed in the upper plate portion 111 in the vicinity of a distal end of the retainer 25 in the fitting direction. The slide rail 147 is connected to the upper plate portion 111 of the retainer 25 at a rear end of the slide rail 147 in the fitting direction of the connector 11. The slide rail 147 extends along the attachment direction. The slide rail 147 is provided on the front end side in the attachment direction of the retainer 25. In other words, the slide rail 147 is provided on the second side of the retainer 25.

The guide rail 145 of the connection portion 44 and the slide rail 147 of the retainer 25 are to be engaged with each other along the attachment direction when the retainer 25 is attached to the connection portion 44.

When the retainer 25 is attached to the connection portion 44, an opened side of the retainer 25 is slightly broaden, and the retainer 25 is pushed from a lateral side of the connection portion 44 and to move along the width direction (attachment direction) such that the connection portion 44 is inserted into the opening the retainer 25. When the retainer 25 is moved in the attachment direction, as shown in FIG. 9A, the retainer projection 117 gets on the groove forming projection 129 and enters the temporary locking groove 123 to be locked (temporary locked position or first position on the connection portion 44). Then, when moving further in the attachment direction, as shown in FIG. 9B, the retainer projection 117 gets on the partition wall 119 and enters the final locking groove 121 (final locked position or second position on the connection portion 44).

When the retainer 25 is in the temporary locked position with respect to the connection portion 44, the lance 141 of the retainer 25 is disposed in the terminal accommodating chamber 45. When the retainer 25 is in the final locked position with respect to the connection portion 44, the final locking projection 143 of the retainer 25 is disposed in the terminal accommodating chamber 45 together with the locking lance 141.

Further, as shown in FIG. 10A, when the retainer 25 is disposed at the temporary locked position with respect to the connection portion 44, the slide rail 147 of the retainer 25 is engaged with the guide rail 145 of the connection portion 44. Further, as shown in FIG. 10B, the guide rail 145 of the connection portion 44 and the slide rail 147 of the retainer 25 are maintained in a state of being engaged with each other even when the retainer 25 in the temporarily locked position is pushed in and moved to the final locked position.

The CPA 21 is made of synthetic resin, covers the female housing 13 from the rear and is to be slidably attached along the fitting direction. The CPA 21 is formed with a pair of left and right side walls 87 that rise at intervals in the width direction, and a support wall 89 that bridge the upper end portions of the side walls 87, and a CPA upper arm 91 extending toward the male housing 15 is formed in a central portion of the support wall 89.

The CPA upper arm 91 is supported in a cantilever manner on the support wall 89, and is provided so as to be inclined downward toward the hood portion 29 of the male housing 15. An upper locking claw 93 extending downward is formed at a distal end portion of the CPA upper arm 91. An inclined surface 95 is formed on a lower front surface of the upper locking claw 93. The CPA upper arm 91 is elastically deformable by the upper locking claw 93 swinging upward (outward) with the rear end portion as a fulcrum. When the CPA 21 is attached to the female housing 13, the upper locking claw 93 of the CPA upper arm 91 gets on the operation portion 59 of the lock arm 57 and comes into contact with rear end portions of the locking pieces 55 of the housing arm 51. When the two housings 13, 15 are being fitted to each other, the rear end portions of the locking pieces 55 are pressed toward the front side in the fitting direction (forward) by the upper locking claw 93.

The CPA 21 includes a CPA lower arm 99 that is supported in a cantilever manner, the CPA lower arm 99 being at a position facing the CPA upper arm 91 (a position substantially 180 degrees apart) and extends toward the male housing 15. A lower locking claw 101 extending inward of the CPA 21 is formed at a distal end portion of the CPA lower arm 99. An inclined surface 103 is formed on an upper front surface of the lower locking claw 101. In the CPA lower arm 99, similarly to the CPA upper arm 91, the lower locking claw 101 swings downward (outward) with a rear end portion as a fulcrum being elastically deformable.

Next, an assembly procedure of the connector 11 of the present embodiment will be described. First, the sealing member 23 is attached to the female housing 13, and the retainer 25 is attached to the temporary locked position on the connection portion 44 which protrudes from the outer housing 43. Then, the lance 141 of the retainer 25 is disposed in the terminal accommodating chamber 45. Next, the female terminal 17 to which the electric wire 18 is connected is inserted into the terminal accommodating chamber 45 of the female housing 13 from the rear of the fitting direction. Then, the locking piece 75 formed in the electrical connection portion 71 of the female terminal 17 gets on the lance 141 and is disposed on the front side in the insertion direction. As a result, the female terminal 17 is locked by the lance 141 and is held in a state of being accommodated in the terminal accommodating chamber 45.

Next, the retainer 25 is pushed and slid to the final locked position. Then, the final locking projection 143 of the retainer 25 enters the electrical connection portion 71 of the female terminal 17 from the rear end side of the electrical connection portion 71. As a result, the female terminal 17 is locked to the retainer 25 with the lance 141 and the final locking projection 143. In other words, a rear end side of the female terminal 17 is disposed between a front end side of the female terminal 17 and the final locking projection 143 when the retainer 25 is attached to the connection portion 44 at the final locked position.

In this way, the retainer 25 allows the female terminal 17 to be inserted into the terminal accommodating chamber 45 and the inserted female terminal 17 is locked and retained therein with the retainer 25 being disposed at the temporary locked position. Then the female terminal 17 is prevented from being fallen off from the terminal accommodating chamber 45 with the retainer 25 being disposed at the final locked position.

When the retainer 25 in the temporary locked position is pushed to be in the final locked position with the female terminal 17 being incompletely inserted into the terminal accommodating chamber 45, the final locking projection 143 of the retainer 25 interferes with the electrical connection portion 71 of the female terminal 17. That is, when the female terminal 17 is in the half-insertion state, the retainer 25 cannot be pushed into the final lacked position. As a result, the operator can recognize that the female terminal 17 is in the half-insertion state.

Figure 11:
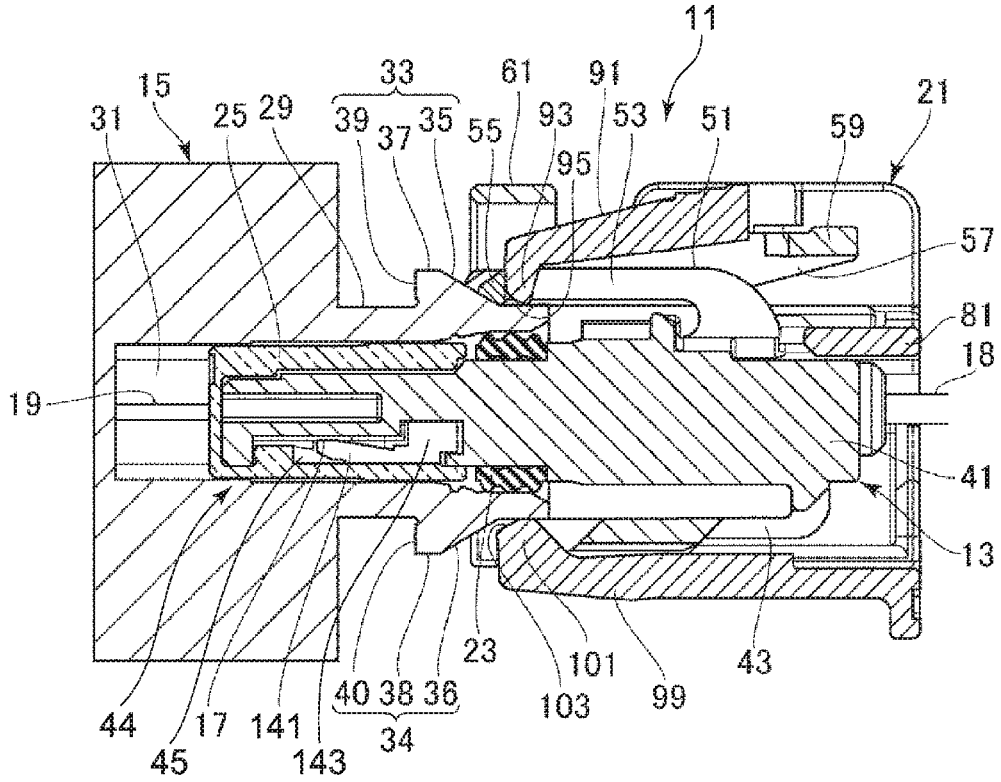
FIG. 11 is a longitudinal cross-sectional view before the connector being fitted to the mating connector.
Figure 12:
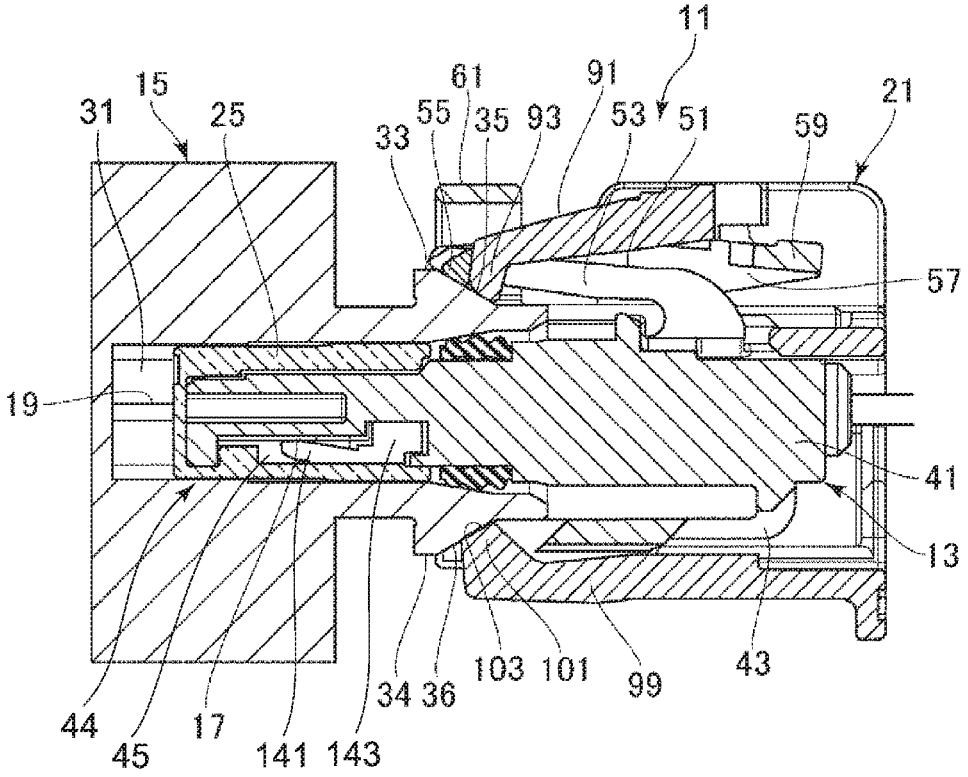
FIG. 12 is a longitudinal cross-sectional view in the middle of the connector being fitted to the mating connector.
Figure 13:
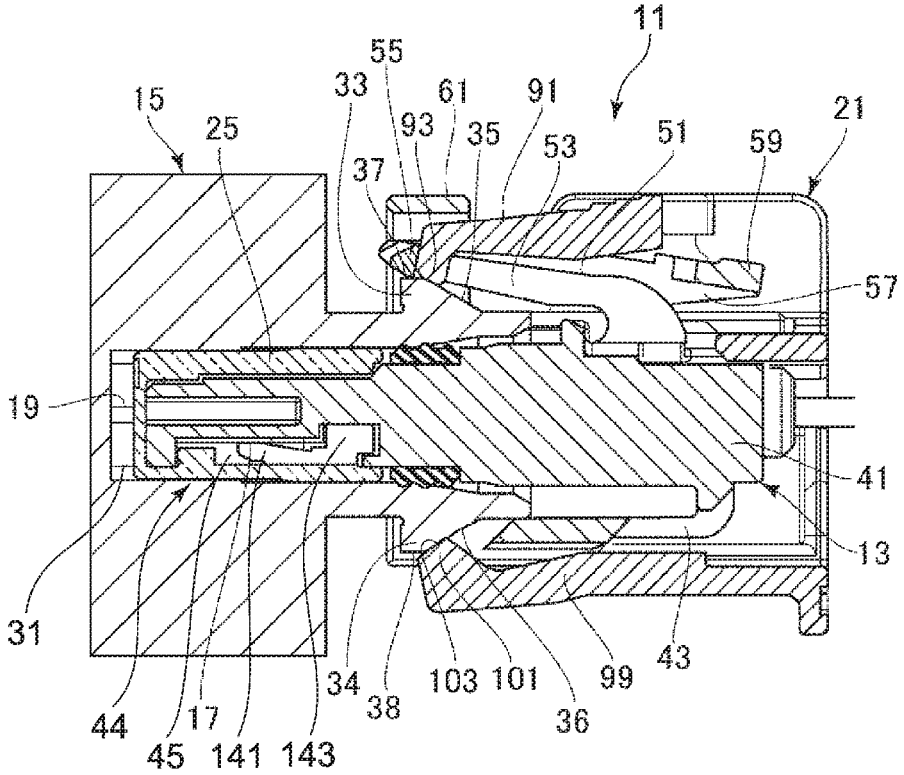
FIG. 13 is a longitudinal cross-sectional view in the middle of the connector being fitted to the mating connector.
Figure 14:
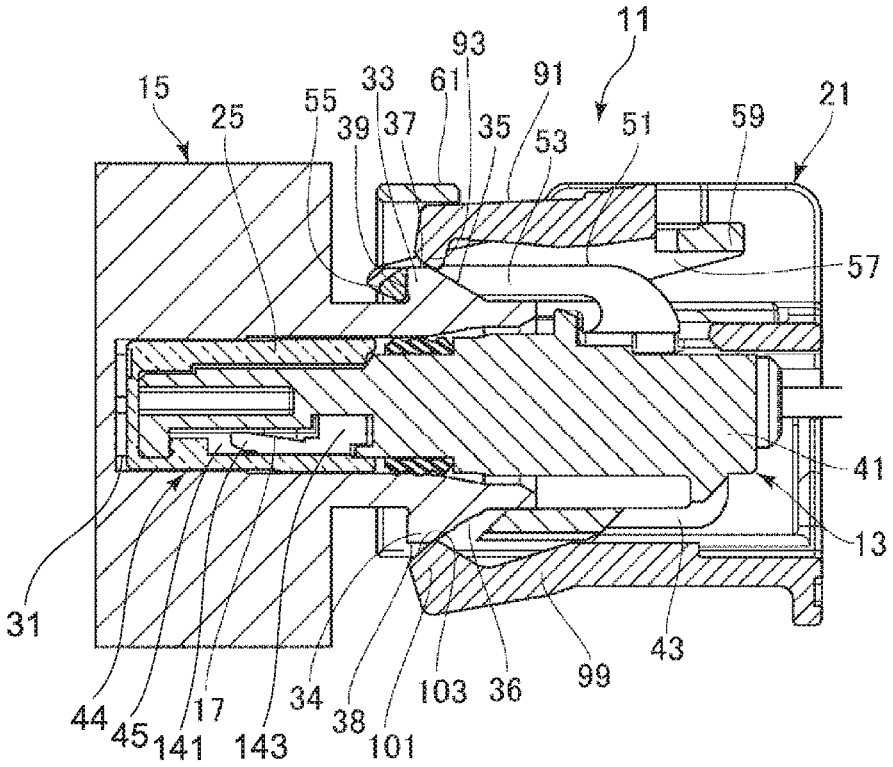
FIG. 14 is a longitudinal cross-sectional view of a fitted state to the mating connector.

Next, a fitting procedure of the connector 11 of the present embodiment will be described. FIG. 11 is a longitudinal cross-sectional view before the connector being fitted to the mating connector. FIGS. 12 and 13 are longitudinal cross-sectional views in the middle of the connector being fitted to the mating connector. FIG. 14 is a longitudinal cross-sectional view of a fitted state to the mating connector.

As shown in FIG. 11, the CPA 21 is attached to the female housing 13 from the rear, and the CPA 21 is moved forward. Then, the CPA upper arm 91 gets in contact with the locking pieces 55, and the female housing 13 moves forward together with the CPA 21. With this state, the CPA 21 is pushed to the front direction in the fitting direction (forward). Then, the inner housing 41 of the female housing 13 is inserted into the hood portion 29 of the male housing 15, and the distal end portion of the male terminal 19 is inserted into the insertion hole 47.

When the CPA 21 is further pushed in the fitting direction, the locking pieces 55 of the housing arm 51 reach the upper inclined surface 35 of the upper locking projection 33 and gets thereon, and start sliding on the upper inclined surface 35, and the housing arm 51 elastically deforms upward by being pressed at the locking pieces 55 against the upper inclined surface 35. As a result, a restoring force of the housing arm 51 acts on the upper inclined surface 35, and the male housing 15 is biased in a direction opposite to the fitting direction by the female housing 13, and the female housing 13 receives a reaction from the male housing 15. As a result, when a hand holding the CPA 21 is released, the female housing 13 is pushed back together with the CPA 21 in the direction opposite to the fitting direction.

As shown in FIG. 12, when the CPA 21 is further pushed in the fitting direction, the upper locking claw 93 of the CPA upper arm 91 reaches the upper inclined surface 35 of the upper locking projection 33 and get thereon, and starts sliding on the upper inclined surface 35. In the CPA upper arm 91, the upper locking claw 93 is pressed against the upper inclined surface 35 and elastically deforms upward. Thus, a restoring force of the CPA upper arm 91 acts on the upper inclined surface 35, and the male housing 15 is biased in the direction opposite to the fitting direction by the CPA 21, and the CPA 21 receives a reaction from the male housing 15. When the upper locking claw 93 of the CPA upper arm 91 starts sliding on the upper inclined surface 35 of the upper locking projection 33, the locking pieces 55 of the housing arm 51 still keep sliding on the upper inclined surface 35. The female housing 13 also receives a reaction from the upper inclined surface 35 due to the elastic deformation of the locking pieces 55. Further, the lower locking claw 101 of the CPA lower arm 99 starts sliding on the lower inclined surface 36 of the lower locking projection 34 at substantially the same timing as the upper locking claw 93 of the CPA upper arm 91 starts sliding on the upper inclined surface 35. In the CPA lower arm 99, the lower locking claw 101 is pressed against the lower inclined surface 36 and elastically deforms downward. As a result, a restoring force of the CPA lower arm 99 acts on the lower inclined surface 36, and the male housing 15 is biased in the direction opposite to the fitting direction by the CPA 21, and the CPA 21 receives a reaction from the male housing 15.

As shown in FIG. 13, when the CPA 21 is further pushed to the front side in the fitting direction, the locking pieces 55 of the housing arm 51 get on the upper inclined surface 35 and reach the upper flat surface 37. Thus, the restoring force of the housing arm 51 does not act on the upper inclined surface 35, and the housing arm 51 stops pushing back the male housing 15. Therefore, the CPA 21 receives the reaction from the upper inclined surface 35 due to the elastic deformation of the upper locking claw 93 and the reaction from the lower inclined surface 36 due to the elastic deformation of the lower locking claw 101.

As shown in FIG. 14, when the locking pieces 55 proceed beyond the upper flat surface 37, the locking pieces 55 are restored and displaced to be locked by the upper locking surface 39 of the upper locking projection 33, and the both housings 13, 15 are locked to each other (connector fitted state). At the time of completion of the fitting, the upper locking claw 93 of the CPA upper arm 91 is still located on the upper inclined surface 35, and the lower locking claw 101 of the CPA lower arm 99 is also located on the lower inclined surface 36. Therefore, the CPA 21 repeatedly receives the reaction from the upper inclined surface 35 due to the elastic deformation of the upper locking claw 93 and the reaction from the lower inclined surface 36 due to the elastic deformation of the lower locking claw 101.

Subsequently, the upper locking claw 93 proceeds beyond the upper flat surface 37 and the locking pieces 55 engaged with the upper locking projection 33, and is then restored and displaced to be locked to the upper locking surface 39 with the locking pieces 55 held there between (see FIG. 4). In this way, both the housings 13, 15 are always locked when the CPA upper arm 91 is locked to the upper locking projection 33. Therefore the fitting of both the housings 13, 15 is ensured by the fitting of the CPA upper arm 91. Since the locking pieces 55 are sandwiched between the upper locking projection 33 and the upper locking claw 93, detachment of the female housing 13 is prevented. The lower locking claw 101 is restored and displaced at substantially the same timing as the locking of the upper locking claw 93 and is locked to the lower locking surface 40 of the lower locking projection 34 after passing through the lower flat surface 38.

The retainer 25, which is attached from the side of the connection portion 44 of the female housing 13, is formed in a U shape in a cross-sectional view in which the opened side is easy to open. Therefore, when an external force acts on the retainer 25 attached to the connection portion 44 or the electric wire 18 is tensioned and a force therefrom is applied to the retainer 25 from the female terminal 17, the retainer 25 may be opened and the female terminal 17 may not be sufficiently locked. When the retainer 25 is forcibly pushed in the half-insertion state in which the female terminal 17 is incompletely inserted into the terminal accommodating chamber 45, the retainer 25 is opened on the opened side, and the final locking projection 143 gets on the electrical connection portion 71 of the female terminal 17. Therefore, even though the female terminal 17 is in the half-insertion state, the retained 25 may be attached to the connection portion 44.

In contrast, in the connector 11 according to the present embodiment, when the retainer 25 is attached to the connection portion 44 of the female housing 13, the guide rail 145 formed in the connection portion 44 and the slide rail 147 formed on the retainer 25 are engaged with each other along the attachment direction. Thus, by the external force acting on the retainer 25 attached to the connection portion 44 or force from the female terminal 17 applied when the electric wire 18 is pulled, it is possible to prevent a situation in which the plate portions 111, 113 of the retainer 25 are opened and the female terminal 17 is not sufficiently locked or the retainer 25 is detached from the connection portion 44.

Even when the retainer 25 is forcibly pushed toward the final locked position and moved when the female terminal 17 is in the half-insertion state, the plate portions 111, 113 of the retainer 25 are prevented from being opened by virtue of the engagement between the guide rail 145 and the slide rail 147. For this reason, the retainer 25 cannot be forcibly moved to the final locked position. That is, it is also possible to prevent a situation where the half-insertion state of the female terminal 17 cannot be recognized, that may occur when the female terminal 17 is in the half-insertion state with respect to the terminal accommodating chamber 45 and the retainer 25 is deformed and the plate portions 111, 113 are opened, resulting in the retainer 25 being attached to the connection portion 44 with the female terminal 17 being only half inserted.

That is, deformation of the retainer 25 can be prevented, and the locking of the female terminal 17 by the retainer 25 can be reliably maintained.

In particular, since the slide rail 147 is provided on the front end side in the attachment direction at which the plate portions 111, 113 are easy to open, the opening between the plate portions 111, 113 when the retainer 25 is attached to the connection portion 44 and after the attachment can be effectively prevented.

While the present invention has been described with reference to certain exemplary embodiments thereof, the scope of the present invention is not limited to the exemplary embodiments described above, and it will be understood by those skilled in the art that various changes and modifications may be made therein without departing from the scope of the present invention as defined by the appended claims.

For example, in the present embodiment, the connector 11 including the CPA 21 has been described as an example, but the present invention is also applicable to a connector that does not include the CPA 21.

According to an aspect of the embodiments described above, a connector structure has a housing (for example, female housing 13) including a connection portion (44), the connection portion (44) including a terminal accommodating chamber (45) configured to accommodate a terminal (for example, female terminal 17) and a retainer (25) configured to be attached to the connection portion (44) from a lateral side of the connection portion (44) and to lock, when the retainer (25) is attached to the connection portion (44) from the lateral side of the connection portion (44), the terminal (for example, female terminal 17) accommodated in the terminal accommodating chamber (45). The connection portion (44) includes an upper portion and a lower portion, at least one of the upper portion and the lower portion having a guide rail (145) extending along a direction in which the retainer (25) is attached to the connection portion (44). The retainer (25) includes a pair of plate portions (111, 113) and a coupling portion (115) coupling the plate portions (111, 113) to each other at a first side of the retainer (25), the plate portions (111, 113) being configured to extend along the upper portion and the lower portion of the connection portion (44) when the retainer (25) is attached to the connection portion (44), the retainer (25) being configured to be attached to the connection portion (44) from a second side of the retainer (25), the second side being opposite to the first side. At least one of the plate portions (111, 113) has a slide rail (147) configured to engage with the guide rail (145) when the retainer (25) is attached to the connection portion (44), the slide rail (147) extending along the direction in which the retainer (25) is attached to the connection portion (44).

According to the connector structure having the above-described configuration, when the retainer is attached to the connection portion, the guide rail formed on the connection portion and the slide rail formed on the retainer get engaged with each other. Therefore, it is possible to prevent the plate portions of the retainer from being opened and thereby the terminal not being sufficiently locked and the retainer being detached from the connection portion, which may occur when the external force is applied on the retainer attached to the connection portion or when a wire connected to the terminal is tensioned and force therefrom is applied to the retainer. In addition, even when the retainer is forcibly pressed and pushed further towani the connection portion with the terminal being only half-inserted, it is possible to prevent the plate portions of the retainer being opened by virtue of the engagement between the guide rail and the slide rail. That is, it is also possible to prevent a situation where the half-insertion state of the terminal is over looked which may occur when the retainer is kept attached to the connection portion with the retainer being deformed in such a way that the plate portions are opened and the terminal is only half-inserted to the terminal accommodating chamber. In short, deformation of the retainer can be suppressed, and the locking of the terminal by the retainer can be reliably maintained.

The slide rail (147) may be provided on the second side of the retainer (25).

With this configuration, it is possible to effectively prevent the plate portions to be opened throughout the time when the retainer is being attached to the connection portion and also when the attachment of the retainer to the connection portion is completed, since the slide rail is provided on the front end side in the direction in which the retainer is attached to the connection portion, where the plate portions tend to be easily opened.

The retainer (25) may further include a first locking portion (for example, lance 141) and a second locking portion (for example, final locking projection 143). The first locking portion (for example, lance 141) may be configured to allow, at least when the retainer (25) is attached to a first position on the connection portion (44), the terminal (for example, female terminal 17) to be inserted into the terminal accommodating chamber (45) and to lock the terminal (for example, female terminal 17) accommodated in the terminal accommodating chamber (45). The second locking portion (for example, final locking projection 143) may be disposed, when the retainer (25) is attached to a second position on the connection portion (44), at a rear side of the terminal (for example, female terminal 17) accommodated in the terminal accommodating chamber (45) to lock the terminal (for example, female terminal 17).

With this configuration, the terminal can be inserted into the terminal accommodating chamber and locked by the first locking portion with the retainer being disposed at the temporary locked position with respect to the connection portion. Further, the terminal inserted into the terminal accommodating chamber can be locked by the second locking portion with the retainer being disposed in the final locked position with respect to the connection portion. Also, when the retainer is pushed to be in the final locked position with the terminal being incompletely inserted into the terminal accommodating chamber, (half-insertion state), the half-insertion state of the terminal can be recognized since the second locking portion does not enter into the terminal from the rear end thereof but only interferes with the terminal. In addition, even when the retainer is forcibly pushed to be in the final locked position when the terminal is only half-inserted, the opening between the plate portions of the retainer is prevented by the engagement between the guide rail and the slide rail. As a result, the retainer cannot be forcibly moved to the final locked position. Therefore, attachment failure of the retainer due to the half-insertion state of the terminal can be suppressed.

What is claimed is:

1. A connector structure comprising:

a housing comprising a connection portion, the connection portion comprising a terminal accommodating chamber configured to accommodate a terminal; and a retainer configured to be attached to the connection portion from a lateral side of the connection portion and to lock, when the retainer is attached to the connection portion from the lateral side of the connection portion, the terminal accommodated in the terminal accommodating chamber, wherein the connection portion comprises an upper portion and a lower portion, at least one of the upper portion and the lower portion having a guide rail extending along a direction in which the retainer is attached to the connection portion, wherein the retainer comprises a pair of plate portions and a coupling portion coupling the plate portions to each other at a first side of the retainer, the plate portions being configured to extend along the upper portion and the lower portion of the connection portion when the retainer is attached to the connection portion, the retainer being configured to be attached to the connection portion from a second side of the retainer, the second side being opposite to the first side, and wherein at least one of the plate portions of the retainer has a slide rail configured to engage with the guide rail when the retainer is attached to the connection portion, the slide rail extending along the direction in which the retainer is attached to the connection portion, and being disposed, when the terminal is completely inserted into the terminal accommodating chamber, closer to a front end of the terminal than to a middle portion of the terminal in an insertion direction in which the terminal is configured to be inserted into the terminal accommodating chamber.

2. The connector structure according to claim 1, wherein the slide rail is provided on the second side of the retainer.

3. The connector structure according to claim 1, wherein the retainer further comprises a first locking portion and a second locking portion, wherein the first locking portion is configured to allow, at least when the retainer is attached to a first position on the connection portion, the terminal to be inserted into the terminal accommodating chamber and to lock the terminal accommodated in the terminal accommodating chamber, and wherein the second locking portion is disposed, when the retainer is attached to a second position on the connection portion, at a rear side of the terminal accommodated in the terminal accommodating chamber to lock the terminal.

4. The connector structure according to claim 3, wherein the slide rail is disposed closer to the front end of the terminal than the first and second locking portions are to the front end of the terminal.

5. The connector structure according to claim 3, wherein the second locking portion is disposed, when the retainer is attached to the second position on the connection portion, closer to the rear side of the terminal accommodated in the terminal accommodating chamber than the first locking portion is to the rear side of the terminal.

6. The connector structure according to claim 1, wherein an outer surface of the guide rail of the connection portion forms a substantially a planar surface with a front surface of the connection portion, the front surface defining an insertion hole communicating with the terminal accommodating chamber.

* * * * *